US009310144B2

(12) United States Patent
Maurer et al.

(10) Patent No.: US 9,310,144 B2
(45) Date of Patent: Apr. 12, 2016

(54) SPLASH FILL BAR SUPPORT AND METHOD OF MANUFACTURING THEREOF

(71) Applicant: SPX Cooling Technologies, Inc., Overland Park, KS (US)

(72) Inventors: Scott T. Maurer, Overland Park, KS (US); Gregory P. Hentschel, Overland Park, KS (US)

(73) Assignee: SPX Cooling Technologies, Inc., Overland Park, KS (US)

( * ) Notice: Subject to any disclaimer, the term of this patent is extended or adjusted under 35 U.S.C. 154(b) by 145 days.

(21) Appl. No.: 14/024,324

(22) Filed: Sep. 11, 2013

(65) Prior Publication Data

US 2014/0008823 A1 Jan. 9, 2014

Related U.S. Application Data

(63) Continuation of application No. 12/496,083, filed on Jul. 1, 2009, now abandoned.

(51) Int. Cl.
*B01F 3/04* (2006.01)
*F28F 25/08* (2006.01)

(52) U.S. Cl.
CPC ..... *F28F 25/082* (2013.01); *B01F 3/04* (2013.01); *B01F 3/04078* (2013.01); *B01F 3/04482* (2013.01); *F28F 25/087* (2013.01); *Y10T 29/49826* (2015.01)

(58) Field of Classification Search
CPC ..... F28F 25/082; F28F 25/087; B01F 3/04; B01F 3/04078; B01F 3/04468; B01F 3/04475; B01F 3/04482
USPC ..... 261/111, 152, 156, 157, DIG. 11
See application file for complete search history.

(56) References Cited

U.S. PATENT DOCUMENTS 4,663,092 A * 5/1987 Kinney et al. ..... 261/111
7,275,736 B2 * 10/2007 Mockry et al. ..... 261/111

* cited by examiner

*Primary Examiner* — Robert A Hopkins
(74) *Attorney, Agent, or Firm* — Baker & Hostetler LLP

(57) ABSTRACT

A cost-effective cooling tower splash fill bar support assembly that includes a plurality of perforated substantially planar components supporting a plurality of splash fill bars extending therethrough in a manner that distributes stress over a relatively large area, typically by using a splash fill bar support. Also, a method of forming a cooling tower splash fill bar support assembly including a splash fill bar support assembly having substantially planar components and splash fill bar supports.

13 Claims, 4 Drawing Sheets

SPLASH FILL BAR SUPPORT AND METHOD OF MANUFACTURING THEREOF

CROSS-REFERENCE TO RELATED APPLICATIONS

This application claims priority to and is a continuation of U.S. patent application entitled, SPLASH FILL BAR SUPPORT AND METHOD OF MANUFACTURING THEREOF, filed Jul. 1, 2009, having a Ser. No. 12/496,083, the disclosure of which is hereby incorporated by reference in its entirety.

FIELD OF THE INVENTION

The present invention relates generally to cooling towers and components/systems included therein. The present invention also relates generally to methods for forming such cooling towers and/or components/systems included therein.

BACKGROUND OF THE INVENTION

Some currently available evaporative cooling towers are designed to have a hot liquid introduced therein through one or more inlets (e.g., one or more spray nozzles or sprinkler heads) that are located at a relatively elevated positions within the tower. As drops of the liquid travel downward through the tower under the effect of gravity, the liquid is cooled by relatively low-temperature air that is either naturally or forcibly circulated (e.g., using one or more fans) throughout the interior of the tower.

In order to enhance the heat transfer between the aforementioned liquid and air, some currently available cooling towers include a plurality of elongated, horizontally arranged splash fill bars that are dispersed throughout the interior of the tower. During operation of the cooling tower, drops of the liquid fall onto a number of these splash fill bars as the drops make their way from the top to the bottom of the tower. Each time that a drop of the liquid falls onto a splash fill bar, the drop either reforms into a new drop or, with sufficient impact, the initial drop may reform as two or more smaller drops. The initially drop may either bounce off of the bar immediately as one or more new drops or may temporarily spread out in the form of a liquid film on the splash bar surface. In the latter instance, once a sufficient amount of water has accumulated to form new drops on the bottom and/or edges of the bar, these new drops are released from the bar and fall within the cooling tower until they contact another splash bar and the process repeats.

Whether new drops form immediately or pursuant to the formation of the aforementioned film, new exterior drop surfaces are formed. Since the water on the surface of the new drops is warmer than the water that was on the surface of the previous drops, the temperature gradient is increased and the heat transfer between the liquid and circulating air is thus enhanced. Once the liquid reaches the bottom of the tower, it is collected in a relatively cool state, typically in a basin or at a drain.

in currently available cooling towers, the plurality of splash fill bars are supported by a grid made from a fiber-reinforced plastic (FRP), polypropylene (PP) or steel wire. In order to increase the area of contact between the grid and splash fill bars and to thereby delocalize stress that may lead to damage of the fill bars, the splash fill bars typically rest upon "benches" that are manually installed on the grid. Since a commonly sized cooling tower may include 20,000 or more of these "benches," the labor costs involved with the building current cooling towers can become substantial.

SUMMARY OF THE INVENTION

At least in view of the above, it would be desirable to provide novel cooling towers and/or cooling tower splash fill bar support assemblies that are less labor-intensive to manufacture and more cost-effective. It would also be desirable to provide novel, more cost-effective methods for constructing such cooling towers and/or components/systems included therein.

The foregoing needs are met, to a great extent, by one or more embodiments of the present invention. According to one such embodiment, a cooling tower splash fill bar support assembly is provided. The assembly includes a substantially planar component configured to extend through an interior portion of a cooling tower. Also, the substantially planar component includes an opening configured to accommodate a splash fill bar extending therethrough. The assembly also includes a splash fill bar support positioned adjacent to an edge of the opening and extending substantially perpendicularly from the substantially planar component. The support is configured to support a portion of the splash fill bar when the splash fill bar extends through the substantially planar component.

In accordance with another embodiment of the present invention, a method of forming a cooling tower splash fill bar support assembly. The method includes forming an opening through a substantially planar component. The method also includes forming a splash fill bar support adjacent to an edge of the opening, wherein the support is formed to extend substantially perpendicularly from the substantially planar component. In addition, the method also includes positioning a splash fill bar such that the splash fill bar extends through the opening and on both sides of the substantially planar component. Further, the method also includes resting a portion of the splash fill bar on the splash fill bar support.

In accordance with yet another embodiment of the present invention, another cooling tower splash fill bar support assembly is provided. This assembly includes means for extending through an interior portion of a cooling tower, the means for extending including a substantially planar region and an opening configured to accommodate a splash fill bar extending through the opening. This assembly also includes means for supporting a splash fill bar, the means for supporting being positioned adjacent to an edge of the opening and extending substantially perpendicularly from the means for extending, wherein the means for supporting is configured to support a portion of the splash fill bar when the splash fill bar extends through the means for extending.

[There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
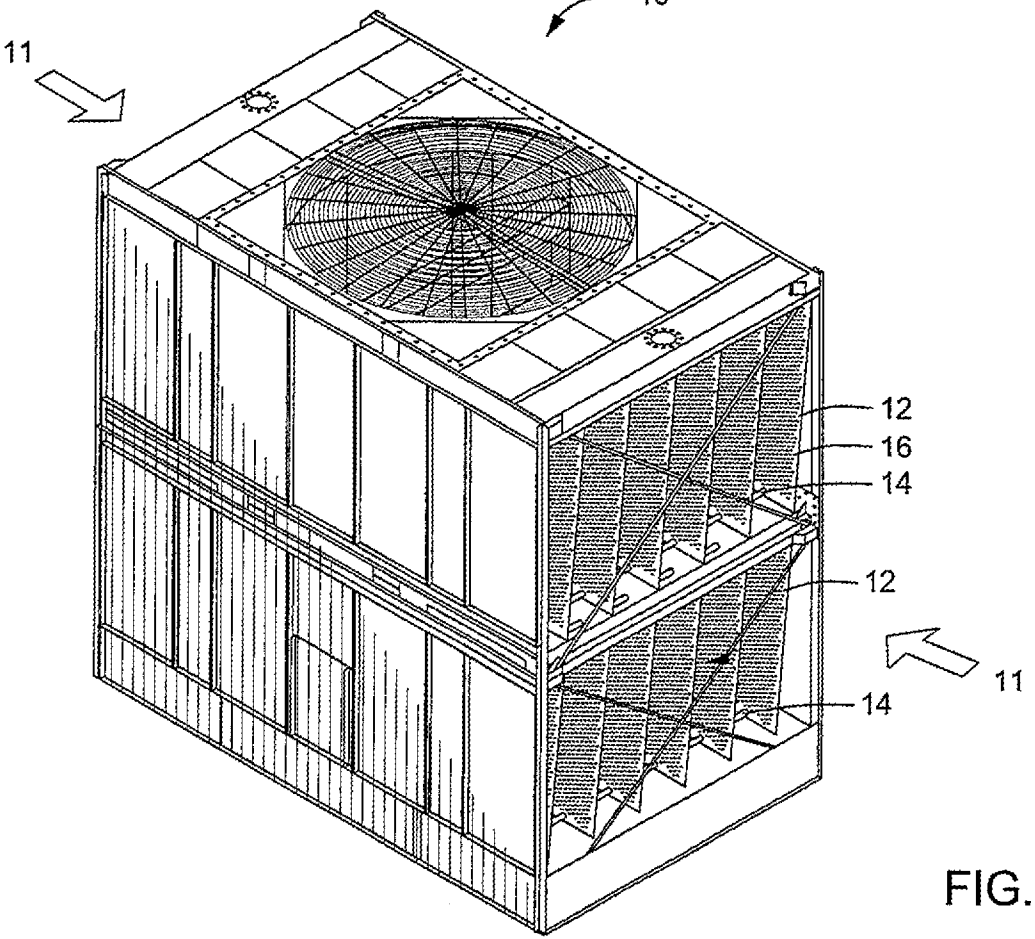
FIG. 1 is a perspective, cross-sectional view of a cooling tower according to one embodiment of the present invention that illustrates portions of a splash fill bar support assembly included therein.

The invention will now be described with reference to the drawing figures, in which like reference numerals refer to like parts throughout. FIG. 1 is a perspective, cross-sectional view of a cooling tower 10 according to one embodiment of the present invention that illustrates portions of a splash fill bar support assembly included therein. Air enters the cooling tower 10 via one of the air inlets 11 illustrated in FIG. 1 and then flows though the cooling tower 10. Although two air inlets 11 are illustrated in FIG. 1, cooling towers with additional or fewer air inlets are also within the scope of the present invention.

As illustrated in FIG. 1, the cooling tower 10 includes a plurality of substantially planar components 12 that extend through portions of the interior of the cooling tower 10. More specifically, an upper set and a lower set of substantially planar components 12 are positioned side by side to each other and substantially vertically in the cooling tower 10. Each substantially planar component 12 extends across approximately half of the height of the cooling tower 10. However, cooling tower configurations where more or less than two substantially planar components extend across the height of the cooling tower 10 are also within the scope of the present invention.

As illustrated in FIG. 1, two sets of substantially planar components 12 that are slightly offset and positioned substantially parallel to each other are included in the cooling tower 10 at each air inlet 11. The two set of substantially planar components 12 are located on two levels that are stacked atop one another and each of the substantially planar components 12 is secured spatially by a plurality of structural supports 14 (e.g., guide rods or bars).

Although not explicitly illustrated in FIG. 1, each substantially planar component 12 has a structural support 14 extending through a region proximate to each corner thereof. In other words, each substantially planar component 12 illustrated in FIG. 1 has four structural supports 14 extending through it. However, other configurations (e.g., including the use of more or less than four supports) are also within the scope of the present invention. For example, instead of using structural supports 14 at all, one or more of the substantially planar components 12 may be affixed to other portions of the cooling tower 10. As will be appreciated by one of skill in the art upon practicing one or more embodiments of the present invention, any number of types of fastening methods may be used to secure the substantially planar components 12 according to the present invention. For example, the components 12 may be welded or clamped in place.

Figure 2:
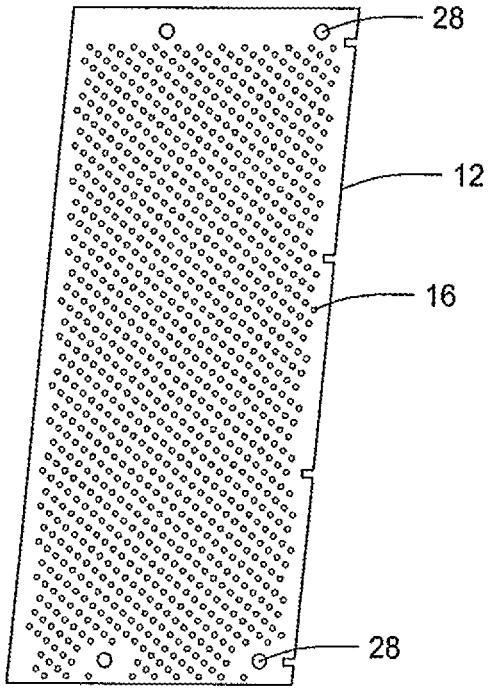
FIG. 2 is a side view of one of the substantially planar components that is included in the cooling tower illustrated in FIG. 1.
Figure 3:
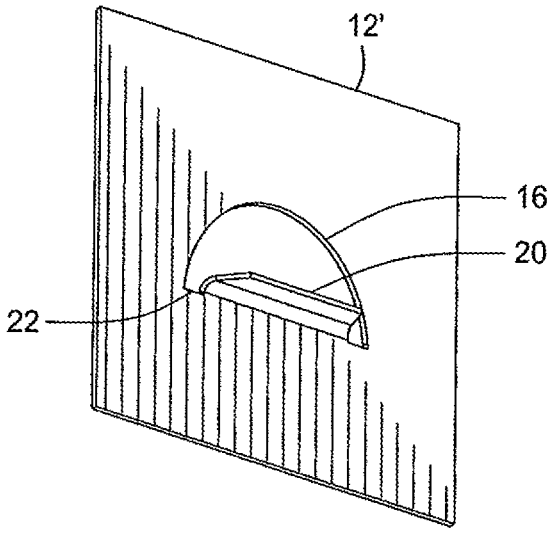
FIG. 3 is a perspective view of a portion of a substantially planar component that may be included in the cooling tower according to another embodiment of the present invention.
Figure 4:
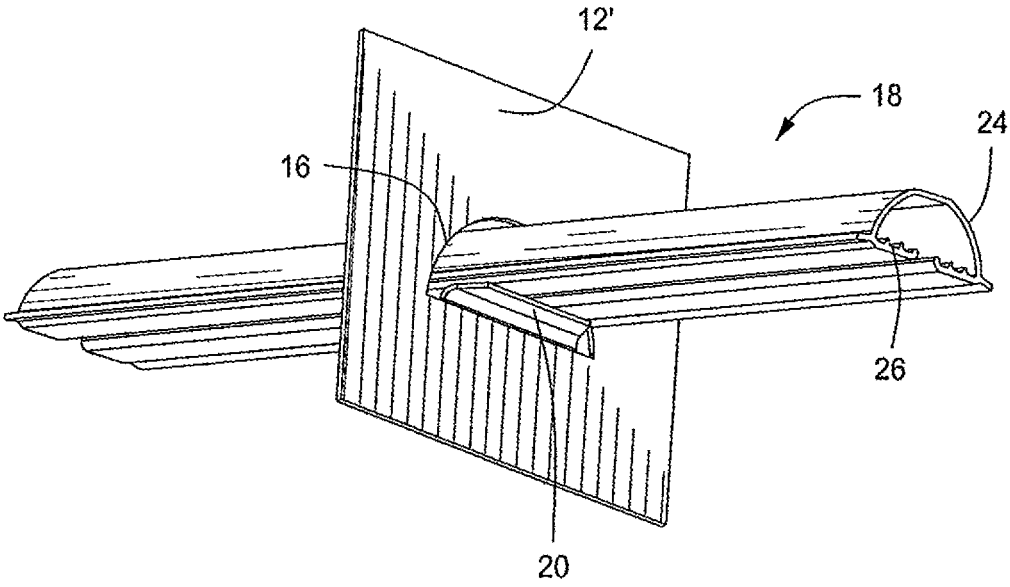
FIG. 4 is a perspective view of the portion of the substantially planar component illustrated in FIG. 3 with a splash fill bar extending therethrough.

FIG. 2 is a side view of one of the substantially planar components 12 that is included in the cooling tower 10 illustrated in FIG. 1. FIG. 3 is a perspective view of a portion of a substantially planar component 12' that may be included in the cooling tower 10 according to another embodiment of the present invention. As illustrated in FIG. 3, the substantially planar component 12' includes an opening 16 configured to accommodate a splash fill bar (not illustrated in FIG. 3) extending therethrough. FIG. 4 is a perspective view of the portion of the substantially planar component 12' illustrated in FIG. 3 with a splash fill bar 18 extending therethrough.

Although the substantially planar component 12 illustrated in FIG. 2 includes a plurality of substantially circular openings 16, there are no particular restrictions on the geometry of the openings 16 according to the present invention. For example, the substantially semi-circular openings 16 illustrated in FIG. 3 are within the scope of the present, as are square openings, rectangular openings, triangular openings, etc.

As illustrated in FIGS. 3 and 4, according to certain embodiments of the present invention, a splash fill bar support 20 is positioned adjacent to an edge 22 of the opening 16. As also illustrated in FIGS. 3 and 4, the splash fill bar support 20 typically extends in a direction that is substantially perpendicular to the substantially planar component 12'. However, supports 20 that extend or protrude from the substantially planar component 12' at other angles are also within the scope of the present invention.

As illustrated in FIG. 4, particularly once incorporated into a cooling tower, the support 20 is configured to support a portion of a splash fill bar 18 as the splash fill bar 18 extends through the substantially planar component 12'. In other words, once a splash fill bar 18 has been threaded though a substantially planar component 12', the bar 18 can rest not only upon the component 12' itself but also upon the support 20. This effective distributes the stresses applied upon the bar 18 and substantially reduces the chance of the bar 18 being damaged. Such distribution of stress can be particularly beneficial during operation of the cooling tower 10 or during transport of prefabricated modules that are sometimes used to build the cooling tower 10. In such situations, the bar 18 may vibrate or move back-and-forth relative to the substantially planar component and highly localized stress could otherwise cause the substantially planar component 12' to effective "saw" through and destroy the splash fill bar 18.

The splash fill bar support 20 may be bolted, welded, glued, brazed. bonded or otherwise affixed, either directly or indirectly, to the substantially planar component 12' in any manner that will become apparent to one of skill in the art upon practicing one or more embodiments of the present invention. However, the substantially planar component 12' and the support 20 illustrated in FIGS. 3 and 4 are both included in one substantially continuous piece of material. More specifically, the support 20 illustrated in FIGS. 3 and 4 includes material that had been included in the substantially planar component 12' before formation of the opening 16. In other words, as will be discussed in more detail below in the discussion of methods according to the present invention, the opening 16 illustrated in FIGS. 3 and 4 was mechanically punched out of the substantially planar component 12' and the support 20 is made up of a portion of material that was subsequently bent perpendicularly away from the plane of the substantially planar component 12'.

The substantially planar component 12' and the support 20 illustrated in FIGS. 3 and 4 are both made from a metal. More specifically, both are made from stainless steel. However, galvanized metals (e.g., galvanized steel), other metals and/or other materials and composite structures (e.g., plastic-metal composite structures) may be included in either or both of these components 12', 20.

Figure 5:
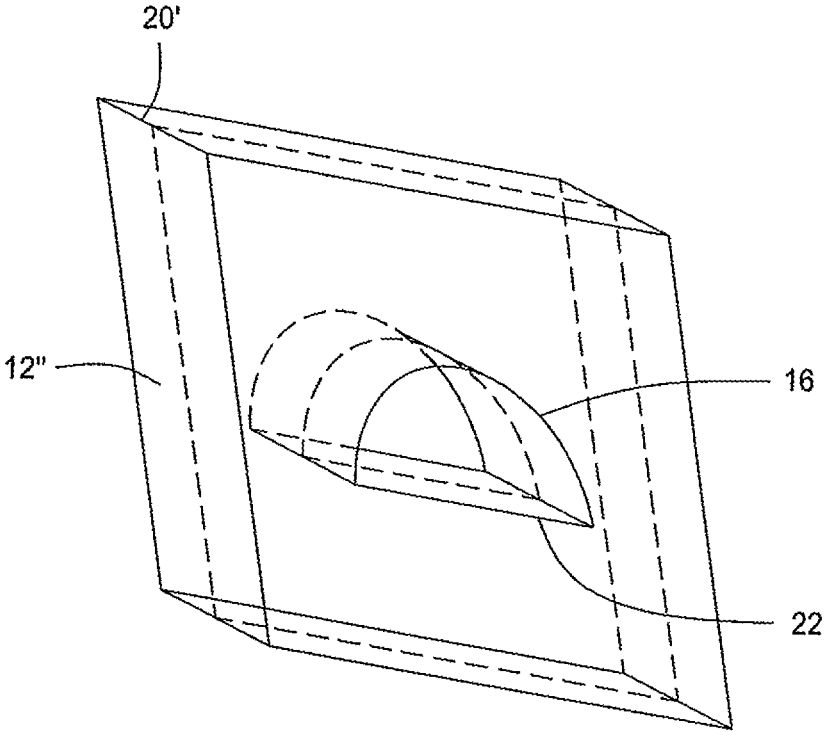
FIG. 5 is a perspective view of a portion of another substantially planar component that may be included in the cooling tower according to yet another embodiment of the present invention.

FIG. 5 illustrates a perspective view of a portion of another substantially planar component 12" that may be included in the cooling tower 10 according to yet another embodiment of the present invention. This substantially planar component 12" and a support 20' are both included with a single piece of polymeric material having a thickness sufficient to appropriately distribute stress so as to substantially reduce the chance of the bar 18 being damaged (e.g., 3/16-inch, 1/4-inch, or thinner). In such configurations, a portion of the thickness (e.g., 1/8-inch, 3/16-inch or thinner) functions as the substantially planar component 12" and the remainder of the thickness functions as the support 20'.

The splash fill bar 18 illustrated in FIG. 4 includes an arcuate water-dispersing region 24 and two substantially planar lip regions 26 that are each connected to water-dispersing region 24. During operation of the cooling tower 10, water drops fall onto the water-dispersing region 24 and are dispersed into re-formed, typically smaller drops. The lip regions 26, on the other hand, are configured to be in contact with the support 20. These components 20, 26, as discussed above, distribute stresses over relatively large contact areas and typically prevent damage of the splash fill bar 18 by the substantially planar component 12'. As will be appreciated by one of skill in the art upon practicing one or more embodiments of the present invention, a lip region 26 may be of any suitable geometry that conforms to support 20 to provide proper contact area. For example, a simple vertical leg of sufficient thickness may be used. Also, according to certain embodiments of the present invention, the splash fill bar 18 is made from or includes at least one of the following materials: wood, a polymeric material (e.g., polyvinyl chloride (PVC), acrylonitrile-butadiene-styrene (ABS), polyethylene (PE), polypropylene (PP)), a fiberglass and a metal (e.g., a steel).

Although a single opening 16 has been discussed in connection with FIGS. 3 and 4, FIGS. 1 and 2 illustrate that, according to certain embodiments of the present invention, the substantially planar component 12 may include a plurality of additional openings 16. As illustrated in FIGS. 1 and 2, each of these additional openings may be configured to accommodate a plurality of additional splash bars (not illustrated) extending therethrough. Although also not explicitly illustrated in FIGS. 1 and 2, the substantially planar component 12 may also include a plurality of splash fill bar supports 20 extending substantially perpendicularly from the plurality of additional openings and configured to contact portions of the plurality of additional splash bars when the plurality of additional splash bars extend through the plurality of additional 16 openings.

Also illustrated in FIG. 2 are a set of additional openings 28 included in the substantially planar component 12 that are configured to accommodate the set of the structural supports 14 extending therethrough as illustrated in FIG. 1. Also the structural supports 14 and additional openings 28 are illustrated as having circular cross-sections in FIGS. 1 and 2, other geometries are also within the scope of the present invention (e.g., squares, pentagons, ovals, etc.).

FIG. 1 illustrates that cooling tower splash fill bar support assemblies according to certain embodiments of the present invention include a plurality of substantially planar components 12 that are positioned substantially parallel to each other. As with the substantially planar components 12 and 12' illustrated in FIGS. 2-4, each of the substantially planar components 12 illustrated in FIG. 1 includes a plurality of openings 16 that are, together, configured to accommodate a plurality of splash fill bars 18 extending therethrough. In other words, when the cooling tower 10 illustrated in FIG. 1 is fully assembled, a plurality of splash fill bars 18 (e.g., 4500 splash fill bars 18) may extend substantially horizontally across the plurality of substantially planar components 12 (e.g., through 48 or more substantially planar components 12).

Each of the plurality of substantially planar components 12 illustrated in FIG. 1 may also include a plurality of splash fill bar supports 20 extending substantially perpendicularly therefrom. As with the previously discussed supports 20 illustrated in FIGS. 3 and 4, the supports 20 included in the substantially planar components 12 illustrated in FIG. 1 are configured to contact portions of the plurality of splash fill bars 18 when the splash fill bars 18 extend through the plurality of additional substantially planar components 12.

Figure 6:
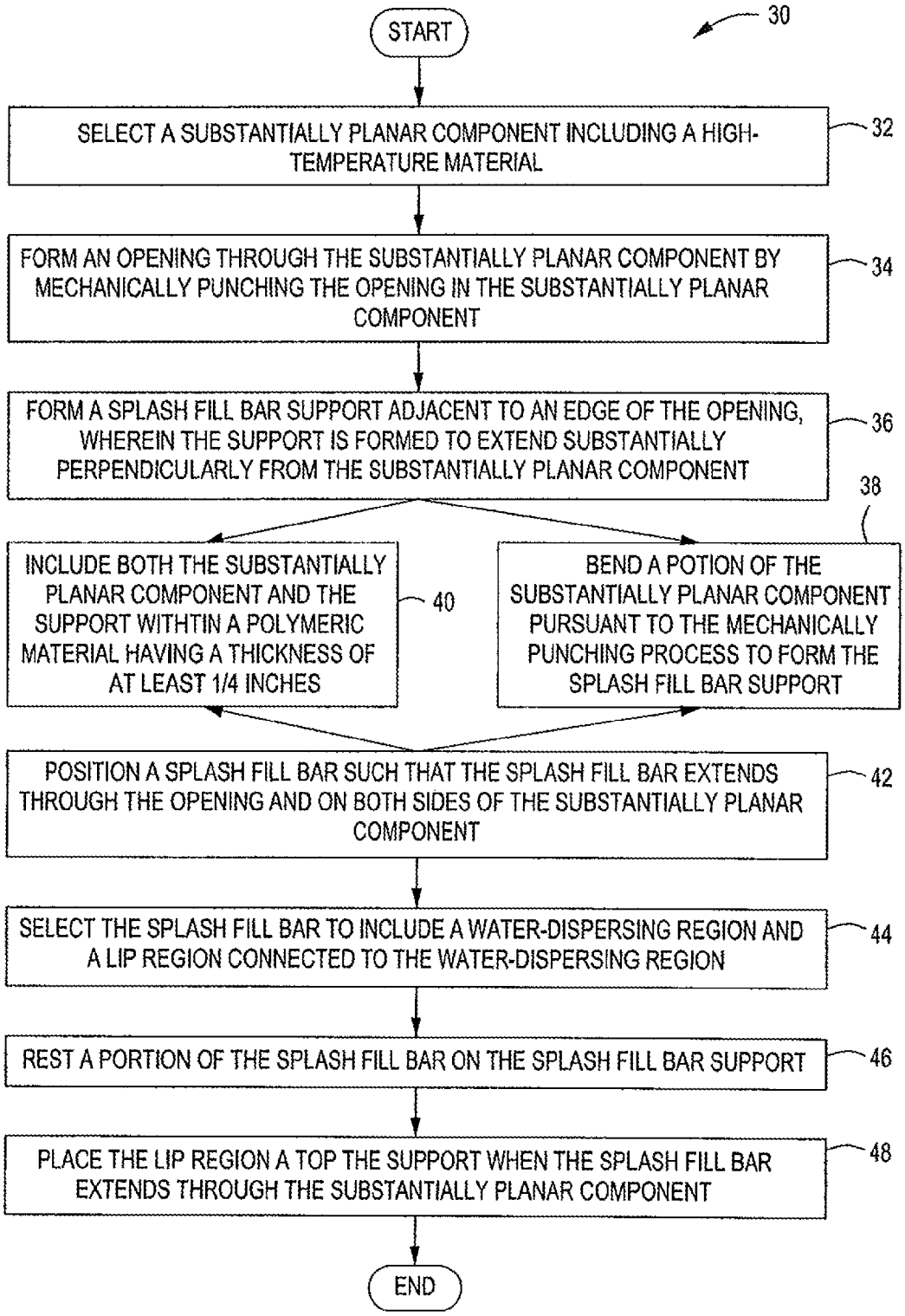
FIG. 6 is a flowchart illustrating steps of a method of forming a cooling tower splash fill bar support assembly according to certain embodiments of the present invention.

FIG. 6 is a flowchart 30 illustrating the steps of a method of forming a cooling tower splash fill bar support assembly (e.g., the structure inside the cooling tower 10 illustrated in FIG. 1) according to certain embodiments of the present invention. Step 32 of the flowchart 30 specifies selecting a substantially planar component (e.g., substantially planar component 12') including a high-temperature material. In other words, step 32 specifies selecting a material that is capable of withstanding temperatures that may typically be found in a cooling tower (e.g., up to, for example, approximately 95.degree. F., approximately 150.degree. F. or some other maximum reasonable operating temperature that depends upon the particular application) without losing structural integrity (i.e., the ability to hold all of the fill bars included within the cooling tower in place). However, according to certain other embodiments of the present invention, a version of step 32 may be implemented without selecting such a high-temperature material.

Step 34 then specifies forming an opening (e.g., opening 16) through the substantially planar component by mechanically punching the opening in the substantially planar component. In order to implement step 34 a turret punch may be used, for example, to punch semicircular holes in a piece of sheet metal (e.g., stainless or galvanized steel). However, other methods of forming an opening are also within the scope of the present invention.

In FIG. 6, step 36 specifies forming a splash fill bar support adjacent to an edge of the opening. Step 36 also specifies that the support is formed to extend substantially perpendicularly from the substantially planar component. As will be appreciated by one of skill in the art upon practicing one or more embodiments of the present invention, this step may, like step 32, also be implemented using a turret punch. More specifically, instead of punching a semicircular opening, a more crescent-shaped opening may be punched through a piece of sheet metal and the residual lip may be bent outward from the plane of the sheet metal. This is effectively the process specified in step 38 wherein a portion of the substantially planar component is bent pursuant to the mechanically punching process to form the splash fill bar support.

As an alternative, step 40 specifies including both the substantially planar component and the support within a polymeric material having a thickness sufficient to appropriately distribute stress so as to substantially reduce the chance of the bar 18 being damaged (e.g., 3/16-inch, 1/4-inch or thinner). According to the embodiment of the present invention specified in step 40, once the opening is formed according to step 34 (e.g., by turret punching or through the use of a water jet), the splash fill bar support has already inherently been formed.

Step 42 in FIG. 6 specifies positioning a splash fill bar such that the splash fill bar extends through the opening and on both sides of the substantially planar component. FIG. 4 illustrates the relative positions of an exemplary substantially planar component 12' and splash fill bar 18 pursuant to step 42 having been performed.

Step 44 specifies selecting the splash fill bar to include an arcuate water-dispersing region and a substantially planar lip region connected to the water-dispersing region. However, the selection of other splash fill bar geometries (e.g., substantially flat splash fill bars such as, for example, wood laths) is also within the scope of certain embodiments of the present invention. Step 46 then specifies resting a portion of the splash fill bar on these splash fill bar support. Finally, step 48 further specifies that step 46 may be implemented by placing the lip region atop the support when these splash fill bar extends through the substantially planar component. Again, FIG. 4 illustrates the relationship between an exemplary substantially planar component 12' and splash fill bar 18 pursuant to steps 46 through 48 having been carried out. However, one of skill in the art will appreciate, upon practicing one or more embodiments of the present invention, that other splash fill bar geometries are also within the scope of the present invention and that other ways of supporting such fill bars are also within the scope of the present invention.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A cooling tower apparatus for cooling an industrial fluid or the like, said apparatus comprising:

a frame structure;

an air current generator mounted to said frame structure;

splash fill bar support assembly disposed within said frame structure, said splash fill bar assembly comprising:

a substantially planar component configured to extend through an interior portion of frame structure, wherein the substantially planar component includes an opening configured to accommodate a splash fill bar extending therethrough; and a splash fill bar support positioned adjacent to an edge of the opening and extending substantially perpendicularly from the substantially planar component, wherein the support is configured to support a portion of the splash fill bar when the splash fill bar extends through the substantially planar component.

2. The support assembly of claim 1, wherein the substantially planar component and the support are both included in one substantially continuous piece of material.

3. The support assembly of claim 2, wherein the support includes material that had been included in the substantially planar component before formation of the opening.

4. The support assembly of claim 1, wherein the opening is substantially semi-circular.

5. The support assembly of claim 1, wherein the substantially planar component also includes a set of additional openings configured to accommodate a set of structural supports extending therethrough.

6. The support assembly of claim 1, wherein the splash fill bar includes a water-dispersing region and a substantially planar lip region connected to the water-dispersing region and wherein the support is configured to be in contact with the lip region when the splash fill bar extends through the substantially planar component.

7. The support assembly of claim 1, wherein the substantially planar component comprises a metal.

8. The support assembly of claim 7, wherein the substantially planar component comprises at least one of a stainless steel and a galvanized metal.

9. The support assembly of claim 1, wherein the substantially planar component and support are both included within a polymeric material having a thickness sufficient to appropriately distribute stress so as to substantially reduce the chance of the splash fill bar being damaged.

10. The support assembly of claim 1, wherein the substantially planar component comprises a plastic-metallic composite structure.

11. The support assembly of claim 1, wherein the substantially planar component further comprises:

a plurality of additional openings configured to accommodate a plurality of additional splash bars extending therethrough; and a plurality of splash fill bar supports extending substantially perpendicularly from the plurality of additional openings and configured to contact portions of the plurality of additional splash bars when the plurality of additional splash bars extend through the plurality of additional openings.

12. The support assembly of claim 1, further comprising: a plurality of additional substantially planar components positioned substantially parallel to the substantially planar component, wherein each of the plurality of additional substantially planar components comprises:

a plurality of openings configured to accommodate a plurality of splash fill bars extending therethrough; and a plurality of supports extending substantially perpendicularly from the plurality of additional substantially planar component, wherein the plurality of supports are configured to contact portions of the plurality of splash fill bars when the splash fill bars extend through the plurality of additional substantially planar components.

13. The apparatus according to claim 1, wherein said splash fill bar support is integral with said substantially planar component.

* * * * *